United States Patent [19]

Bolduc

[11] Patent Number: 5,012,978

[45] **Date of Patent: * May 7, 1991**

[54] AEROSOL DISPENSER AND METHOD

[76] Inventor: Lee R. Bolduc, 6416 Gainsborough Dr., Raleigh, N.C. 27612

[ * ] Notice: The portion of the term of this patent subsequent to Jul. 17, 2007 has been disclaimed.

[21] Appl. No.: 419,508

[22] Filed: Oct. 10, 1989

Related U.S. Application Data

[63] Continuation-in-part of Ser. No. 251,806, Oct. 3, 1988, Pat. No. 4,941,615.

[51] Int. Cl.[5] ..... B05B 9/04

[52] U.S. Cl. ..... 239/304; 239/309; 222/82

[58] Field of Search ..... 239/309, 303, 304; 206/47 A, 222; 222/402.25, 541, 80–83.5, 134, 135, 402.16, 402.11, 518

[56] References Cited

U.S. PATENT DOCUMENTS

| | | | |
|---|---|---|---|
| 315,610 | 4/1885 | Gee . | |
| 518,258 | 4/1894 | Lechartier . | |
| 1,536,144 | 5/1925 | Robinson . | |
| 1,587,598 | 6/1926 | Magg . | |
| 1,779,959 | 10/1930 | Bellocchio . | |
| 2,167,866 | 8/1939 | Bennett . | |
| 2,716,637 | 8/1955 | Bunting . | |
| 2,921,720 | 1/1960 | Malachick . | |
| 2,930,384 | 3/1960 | Strain et al. . | |
| 3,080,094 | 3/1963 | Modderno . | |
| 3,240,403 | 3/1966 | Modderno . | |
| 3,349,966 | 10/1967 | Schwartzman . | |
| 3,491,916 | 1/1970 | Graham . | |
| 3,591,089 | 7/1971 | Cronan . | |
| 3,638,786 | 2/1972 | Borecki et al. | 206/47 A |
| 3,648,899 | 3/1972 | Lukesch et al. . | |
| 3,658,719 | 4/1972 | McConnaughey . | |
| 3,679,102 | 7/1972 | Charle et al. | 222/192.5 |
| 3,718,235 | 2/1973 | Cronan . | |
| 3,773,264 | 11/1973 | Cronan | 239/304 |
| 3,791,980 | 2/1974 | Goldsmith . | |
| 3,966,087 | 6/1976 | Curry et al. | 222/192 |
| 4,121,772 | 10/1978 | Cronan | 239/304 |
| 4,201,316 | 5/1980 | Klingaman | 222/80 |
| 4,387,998 | 6/1983 | Szigeti | 366/130 |
| 4,465,183 | 8/1984 | Saito et al. | 206/222 |
| 4,491,250 | 1/1985 | Liebermann | 222/386.5 |
| 4,613,061 | 9/1986 | Meuresch et al. | 222/82 |
| 4,682,689 | 7/1987 | Pereira et al. | 206/222 |

FOREIGN PATENT DOCUMENTS

| | | |
|---|---|---|
| 1168772 | 12/1958 | France . |
| 215493 | 5/1924 | United Kingdom . |

OTHER PUBLICATIONS

Aerosol Age, Sep. 1985, "Pressure Peaks Challenger", pp. 40–42.

*Primary Examiner*—Charles A. Marmor
*Assistant Examiner*—Kevin Weldon
*Attorney, Agent, or Firm*—Burd, Bartz & Gutenkauf

[57] ABSTRACT

An aerosol dispenser having a transparent container for storing propellant and a first compound under pressure. A normally closed valve is mounted on top of the container to control the dispensing of the materials from the container. An ampule containing a second material separate from the first material until the ampule is broken is positioned generally longitudinally along the length of the container with a sleeve. A push rod connected to the valve and extended through a generally cylindrical filter surrounding the valve has a convex shaped finger and an inclined shoulder that cooperates with a beveled edge of the sleeve to break the ampule when the valve is first moved to an open position. The materials are mixed within the container and move through the filter before entering the valve. The mixed materials and propellant are dispensed through a nozzle of an actuator member mounted on the container when the actuator member is depressed causing the valve to open.

51 Claims, 9 Drawing Sheets

AEROSOL DISPENSER AND METHOD

CROSS REFERENCE TO RELATED APPLICATION

This application is a continuation-in-part of U.S. application Ser. No. 251,806, filed Oct. 3, 1988, now U.S. Pat. No. 4,941,615.

FIELD OF INVENTION

The invention relates to an aerosol container and dispenser for holding materials which must normally be maintained in separated conditions until immediately prior to use. The invention includes a method for storing and mixing materials and dispensing the mixed materials as a foamed mousse.

BACKGROUND OF INVENTION

Many compounds would be advantageously used if they could be dispensed from an aerosol container Some of these compounds have a relatively short shelf life and have components that cannot be intermixed until just prior to use. Separation of the compounds in the container may be necessary to limit pressure within the container. Mixing of the compounds within the container avoids spillage which can change the ratio of the compounds required for a satisfactory product. Aerosol containers that include a frangible secondary container have been used to hermetically separate two chemical ingredients that must be mixed together immediately prior to spraying. An inertia means, such as a steel ball, has been placed in the secondary container so that by shaking the entire aerosol container the inertia means shatters the secondary container allowing the two chemicals to be mixed together allowing a chemical mixture to be sprayed to a desired location. An example of this structure is shown by Cronan in U.S. Pat. No. 4,121,772.

SUMMARY OF INVENTION

An aerosol package shown and described in *Aerosol Age*, April 1986, has an ampule that keeps the reactive compounds in the system separated until ready for use. When the valve is actuated, the ampule is broken and its contents mix with other chemicals and/or a propellant. The ampule is made of a frangible material, such as glass. A rod mechanism extends from the valve downwardly into the container. The lower end of the rod has a saddle that traps the ampule transversely against the bottom of the container. When the valve stem is depressed, the rod shatters the ampule. This aerosol system allows one to use an aerosol spray containing material having a relatively short shelf life. The size of the ampule lying on the bottom of the container is limited by the diameter of the container and the diameter of the opening into the container.

The aerosol dispenser and material storing and dispensing method of the invention has a container for storing a propellant and materials, such as liquids and chemicals, that are to be discharged to a desired location. The dispenser stores two or more separated materials that are mixed together within the container immediately prior to use. A wide range of ratios of materials can be selected by using different size ampules for storing secondary materials. The dispenser can be effectively used to produce aerosol foam, spray and mousse containing hair care products, such as hair permanents, hair relaxers, hair dyes, hair sunscreens, hair stylers and shampoos. Ampule breaking structure associated with the control valve is manually operated to fracture the ampule thereby allowing the materials in the ampule and container to mix with each other. The container can be made of transparent materials to permit visual inspection of the integrity of the ampule and the contents of the container, such as the color of the hair dye.

The container has an open top that is closed with a cap that supports a normally closed control valve. The control valve has a moveable tubular member which can be manually moved into the container to open the valve to allow propellant and material to be dispensed therefrom. A frangible ampule is located within the container for storing a second material separated and isolated from the first material The ampule is an elongated closed glass vessel that is positioned longitudinally along the length of the container. The ampule is normally located in a generally upright position. An annular member, such as a sleeve or ring, located within the chamber has a passage for accommodating a portion of the ampule to retain it in a generally upright position. The ampule breaking structure has a push rod connected to the bottom of the moveable member of the valve. The push rod extends through a filter surrounding and mounted on the bottom portion of the valve housing. The filter prevents foreign material, such as broken glass and the like, from entering the valve and being dispensed from the dispenser. The filter also is used to guide and support the push rod. In one form of the invention, a second rod accommodating a button is mounted on the tubular member. The lower end of the rod fits tightly into the passage of the tubular member to prevent escape of materials from the container when the tubular member is first moved to break the ampule.

The push rod extends into the passage of the annular member adjacent the side of the ampule. The push rod and annular member have cooperating wedge surfaces so that when the moveable member is first moved into the chamber the push rod crushes or breaks the ampule whereby the second material is mixed with the first material in the chamber. After the ampule is broken an actuator member mounted on the container is used to operate the valve in a normal manner to dispense the mixed materials as a foam, spray, or mousse to a selected location.

A preferred embodiment of the aerosol dispenser and two-part composition storing and dispensing method has an elongated cylindrical transparent glass container having a bottom wall, an open top, and a chamber for storing a propellant and material such as a liquid. A cap mounted on the container closes the open top and supports a normally closed control valve. The container has an actuator member that is mounted on the cap. The control valve has an upwardly directed tubular stem that is closed with a removable cap member. The cap member is removed from the actuator member so that when the stem is moved relative to a seal to open the valve, the propellant and the material is dispensed from the container as a foam, spray, or mousse or jet through the nozzle of the actuator member.

An elongated frangible ampule is located within the chamber for storing a second material separate and isolated from the first material. A rigid cylindrical sleeve accommodates the lower end of the ampule to hold the ampule in a generally upright position in the chamber. This upright position is generally parallel to the longitudinal dimension or length of the chamber.

The upright location of the ampule in the chamber allows a relatively large ampule to be stored within the chamber. This allows the aerosol dispenser to have a large range of ratios of the first and second materials. The second material in the ampule being separated and isolated from the first material in the container increases the shelf life of the product and minimizes the deterioration of the gasket and seal structures of the control valve. The sleeve has open upper and lower ends. The upper end of the sleeve has an inside annular downwardly tapered edge or chamfer. A push rod connected to the moveable member extends downwardly into the passage of the sleeve. A generally cylindrical filter mounted on the lower portion of the valve housing supports and guides the push rod. The push rod has a downwardly directed convex shaped finger that is located within the passage adjacent the ampule. A beveled shoulder on the push rod adjacent to the finger cooperates with the tapered edge on the sleeve to force the rod into the side of the ampule to break the ampule when the stem is moved down or depressed. The second material in the ampule flows into the chamber where it is mixed with the first material and propellant. The mixed materials and propellant move through the filter and into the valve when the valve is opened thereby allowing the mixed materials to be dispensed as a spray, foam, or mousse to a desired location. The filter prevents particulates from entering the valve and being dispensed from the dispenser. A protective cover is mounted on the actuator member to prevent accidental dispensing of materials and premature rupture of the ampule The objects and advantages of the aerosol dispenser and method of the invention are embodied in the dispenser structure and functions as shown in the drawing and described in the specification of the preferred embodiment thereof.

DESCRIPTION OF PREFERRED EMBODIMENTS

Figure 1:
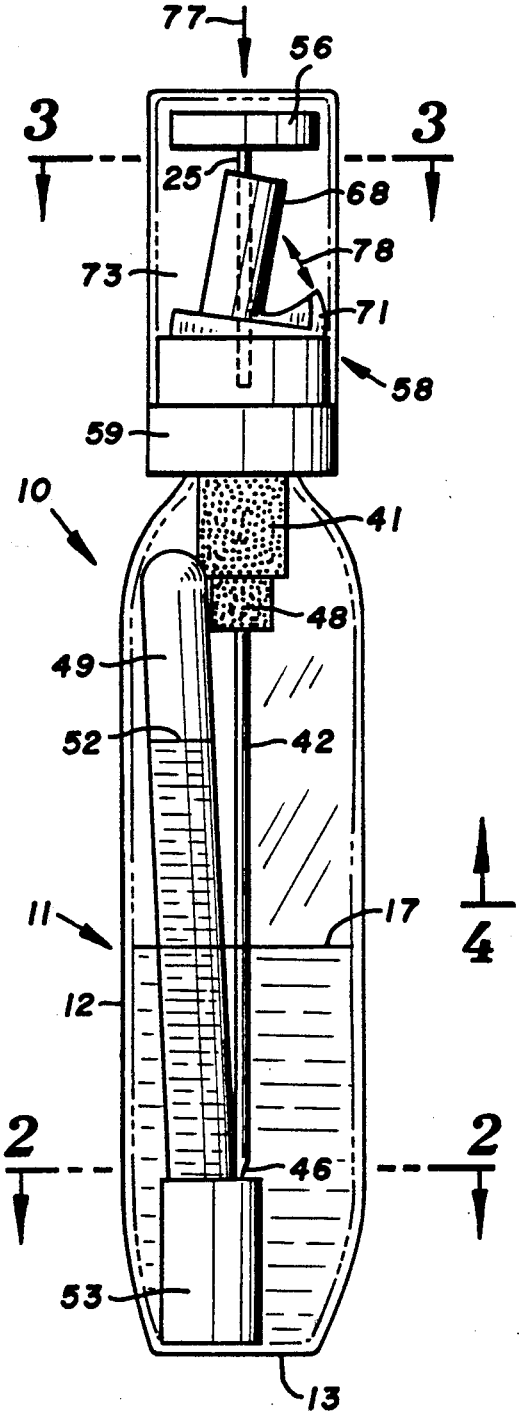
FIG. 1 is a side elevational view of the aerosol foam dispenser of the invention.
Figure 2:
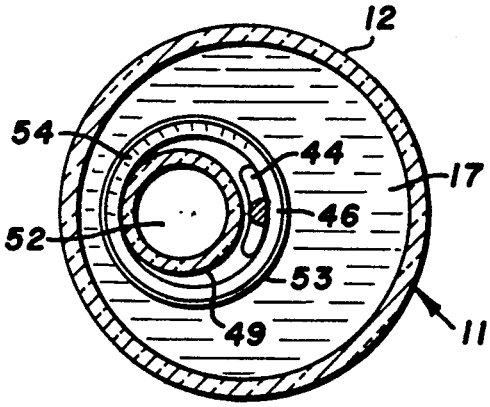
FIG. 2 is an enlarged sectional view taken along line 2—2 of FIG. 1.
Figure 3:
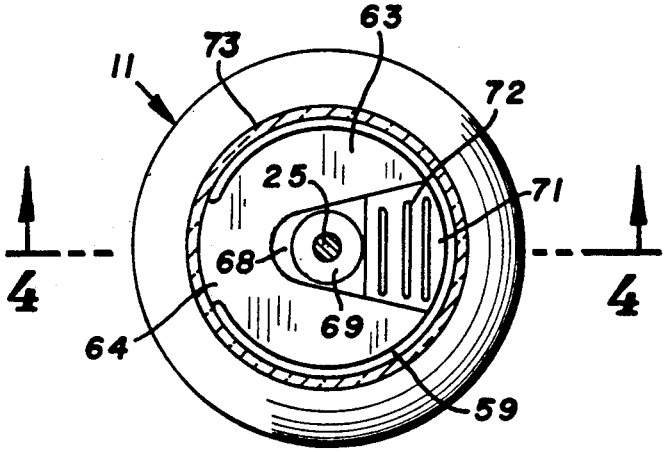
FIG. 3 is an enlarged sectional view taken along the line 3—3 of FIG. 1.

Referring to FIGS. 1, 2, and 3, there is shown the aerosol foam dispenser 10 of the invention for delivering mixed materials with a propellant to a desired location. The materials within dispenser 10 are mixed immediately prior to use so that the effectiveness of the materials is not reduced. Dispenser 10 and the separate materials therein have substantial shelf life since there is little or no reaction within the container prior to the mixing of the materials within the container. Dispenser 10 can be used with materials such as human hair permanents, hair relaxers, hair dyes, hair sunscreens, hair stylers and shampoos hereinafter described.

Dispenser 10 has an external bottle or container 11 made out of transparent material such as glass, plastic or the like. Bottle 11 has a cylindrical side wall 12 joined to a generally flat bottom wall 13. The top of side wall 12 has an annular rim or bead 14 surrounding an opening or mouth into chamber 16 of container 11. A material 17, such as a liquid, is normally stored in chamber 16 along with a propellant which maintains material 17 under pressure within chamber 16. Common Freons and hydrocarbon propellants are suitable propellant materials. Side wall 12 of container 11 has sufficient structural strength to accommodate the pressure of the propellant in chamber 16. The open top of container 11 is closed with a cap 18 that supports a normally closed control valve indicated generally at 19.

Figure 4:
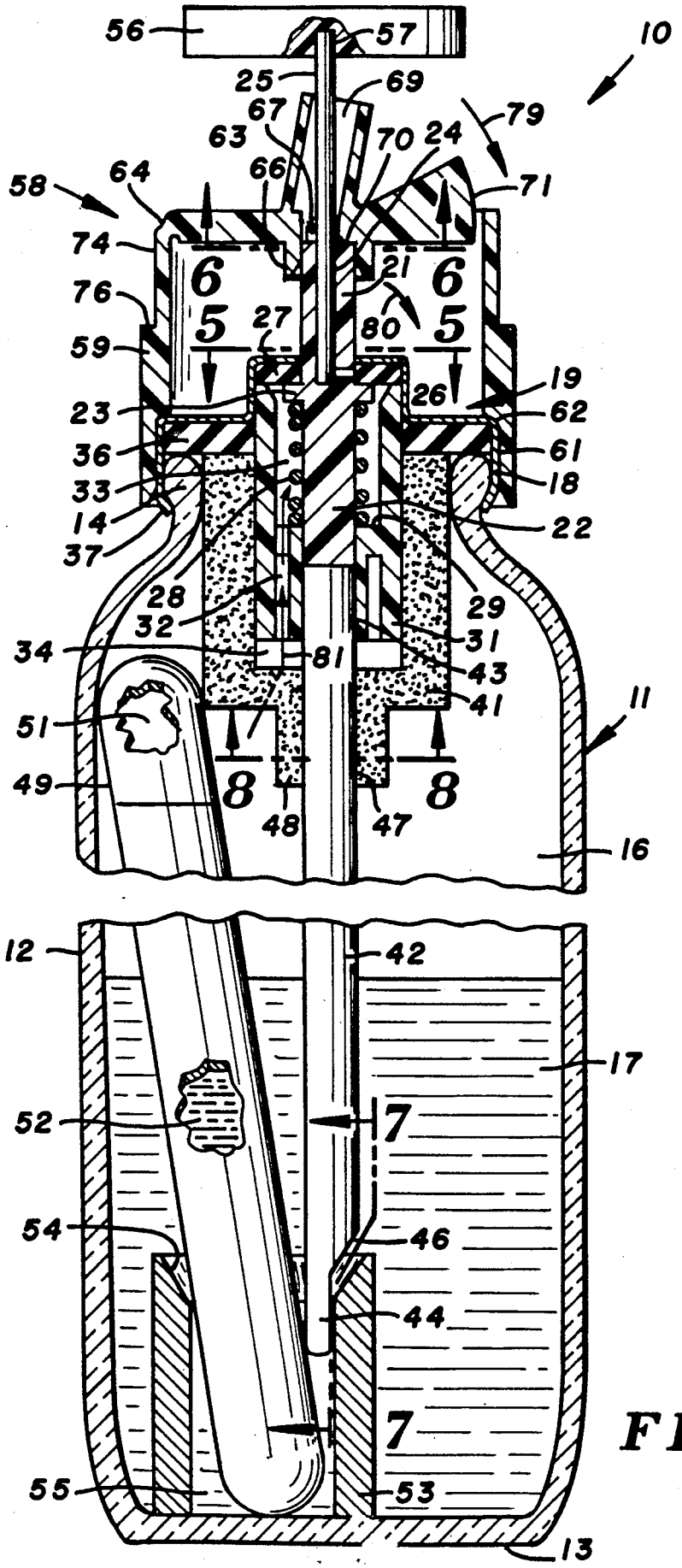
FIG. 4 is an enlarged foreshortened sectional view taken along line 4—4 of FIG. 3.

As shown in FIG. 4, control valve 19 has a generally upright tubular stem 21 that projects upwardly from cap 18. The lower portion of stem 21 has an elongated body 22 having an outwardly directed annular flange 23. Stem 21 has a passage 24 open to the top to the stem and open to a side port 26 that allows the propellant and the material to flow into passage 24. An annular diaphragm 27 surrounding stem 21 is normally aligned with side port 26 to maintain valve 19 in a closed position. A coil spring 28 engages flange 23 to hold stem 21 in an up or closed position. The lower or inner end of coil spring 28 bears against an annular step 29 of a generally cup-shaped housing 31 that surrounds body 22. Housing 31 has lower passages 32 that are in communication with an internal or upper chamber 33 allowing the propellant and material to flow upwardly into chamber 33, as indicated by arrow 81 in FIG. 4, and to side port 26 when control valve 19 is in the open position. Spring 28 biases stem 21 in a closed position as shown in FIG. 4. A tubular filter 41 surrounds the lower end of housing 31. Filter 41 has a cylindrical inside wall positioned in tight fit relation around housing 31 and an outside wall engageable with bead 14 to retain filter 41 on housing 31. The upper end of filter 41 bears against a gasket 36 clamped on bead 14 with cap 18. Propellant and the material flow through filter 41 into bottom chamber 34 before entering passages 32 of valve housing 31. The filter 41 prevents particulates, such as glass particles and the like, from flowing into valve 19 and being dispensed from the dispenser. Filter 41 is a porous polyethylene generally cylindrical member. Other types of materials can be used for filter 41. The pore size of filter 41 is in the range of 45 to 75 microns. The bottom of filter 41 has a cylindrical shaped boss 48 having a smaller diameter than the diameter of the top portion to the filter. Other types of filters can be used to prevent foreign particles from interfering with the operation of control valve 19. Annular gasket 36 of compressible material surrounds housing 31 and bears against the top of bead 14 of container 11. Cap 18 has a clamp ring 37 that is turned about or clamped over gasket 36 and bead 14 to seal cap 18 on container 11.

Figure 8:
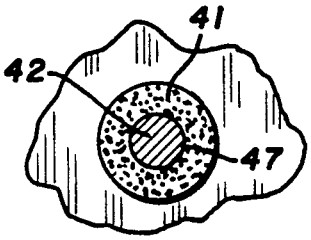
FIG. 8 is a sectional view taken along the line 8—8 of FIG. 4.

The lower portion of body 22 engages a downwardly directed compression or push rod 42. Push rod 42 is an elongated rigid member having a smooth outer cylindrical surface slidably retained on housing 31 so that rod 42 can move with stem 21. Rod 42 is a stainless steel wire rod having a continuous and smooth cylindrical outer surface. Other types of rigid materials can be used to make rod 42. The upper end of rod 42 fits into a hole or recess 43 in the bottom of housing 31. Rod 42 extends downwardly through a hole 47 in boss 48 of filter 41. Rod 42 has a close sliding fit relation with boss 48 to prevent foreign particles from entering passages 32, as shown in FIG. 8. Filter 41 supports and guides push rod 42. Spring 28 also serves as a stop to limit the depression or inward movement of stem 21. Body 22 has a diameter that is smaller than the diameter of chamber 33 so that the propellant and material can freely flow to side port 26 when port 26 is moved below diaphragm 27 to allow the material to flow through the valve 19 and nozzle 68 and be dispensed to a desired location.

As shown in FIGS. 2, 4, 7 and 9, the bottom of push rod 42 has a downwardly directed convex curved finger 44. Finger 44 has a width less than one half the diameter of rod 42. Finger 44 is located adjacent a wedge or shoulder 46 on the lower end of rod 42. Shoulder 46 is preferably at an angle of 45 degrees relative to the longitudinal axis of rod 42. Other angles can be used for wedge shoulder 46. Finger 44 extends downwardly generally parallel to the longitudinal axis of rod 42. The upper end of finger 44 has opposite side edges that diverge upwardly to the opposite side edges of shoulder 46. The lower side edges of finger 44 curve inwardly toward each other and engage the inner surface of a sleeve 53 when control valve 19 is in its closed position.

An elongated cylindrical frangible ampule or vial 49 having a sealed chamber 51 storing a second material 52 such as liquid, chemical, powders, and the like, that is desired to be mixed with material 17 in chamber 16 immediately prior to use of the dispenser. Ampule 49 is made of breakable material, such as a glass vessel located generally along the length of chamber 16. This position of ampule 19 allows a relatively large ampule to be located within chamber 16 so that a wide range of ratios of amounts of materials can be mixed in chamber 16. The diameter of ampule 49 is smaller than the diameter of the opening into chamber 16 to allow it to be placed in chamber 16. The length of ampule 49 can be substantially the same as the longitudinal length of chamber 16. The size of ampule 49 is selected to provide the desired ratio of volumes of material 17 to material 52.

Ampule 49 is retained in its generally upright or longitudinal position with a cylindrical sleeve or holding member 53. Sleeve 53 rests on bottom wall 13 of container 11 and has a passage 55 that accommodates a lower end of ampule 49. Sleeve 53 is a one-piece cylindrical member having an outside diameter slightly smaller than the opening into chamber 16 whereby sleeve 53 can be placed into chamber 16. As seen in FIG. 4, sleeve 53 has an inwardly directed annular chamfer or beveled edge 54 at the top end thereof. Preferably, the angle of edge 54 is at 45 degrees relative to the longitudinal axis of passage 55 of sleeve 53. Other angles can be used for edge 54. Sleeve 53 has open top and bottom ends so that material is not trapped in passage 55. Finger 44 is located in the upper end of sleeve 53 when valve 19 is in the closed position. Wedge shoulder 46 is spaced from edge 54. Finger 44 is located contiguous to the side wall of ampule 49. Ampule 49 is not broken so that material 52 therein is isolated from material 17 in chamber 16. The structural condition of ampule 49 and contents of container 11 can be visually observed through the transparent side wall 12 of container 11.

Figure 5:
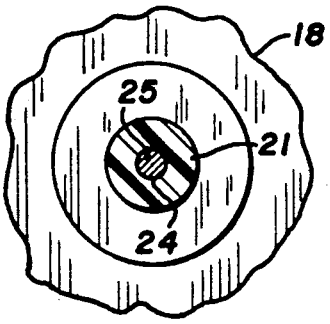
FIG. 5 is a sectional view taken along the line 5—5 of FIG. 4.

The upper end of stem 21 accommodates a rod 25 that closes passage 24. A generally circular button 56 has a bottom central circular recess or hole 57 that accommodates the upper end of rod 25. Rod 25 fits tightly into passage 24 of stem 21, as shown in FIG. 5. Button 56 is used to apply force, as indicated by arrow 82 in FIG. 9, in a downward direction on stem 21. This moves valve 19 to the open position and push rod 42 in a downward direction. Rod 25 prevents materials and propellant under pressure in chamber 16 from being discharged from stem 21. The wedge shoulder 46 engages edge 54 causing the lower end of rod 42 to move laterally into tight engagement with the side of ampule 49. Continued downward movement of push rod 42 continues to exert lateral force on the ampule 49 and wedges the lower end of push rod 42 between the inside of the wall of sleeve 53 and ampule 49. This force of push rod 42 against ampule 49, indicated by arrow 83 in FIG. 9, fractures or breaks ampule 49 thereby releasing material 52 into chamber 16 where it is mixed with material 17. The mixing of the materials can be facilitated by shaking dispenser 10. Sleeve 53 is free to move up and down the length of push rod 42. This allows materials in passage 55 to be thoroughly mixed with all of the material in chamber 16. As soon as ampule 49 is broken, the external force 82 on button 56 can be removed. Spring 28 will then move stem 21 to its closed position as shown in FIG. 4. Button 56 and rod 25 are then removed from stem 21. An actuator member, indicated generally at 58, then can be used to open valve 19 and direct the aerosol foam spray to desired locations.

Figure 6:
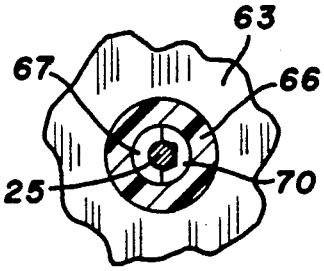
FIG. 6 is a sectional view taken along the line 6—6 of FIG. 4.
Figure 7:
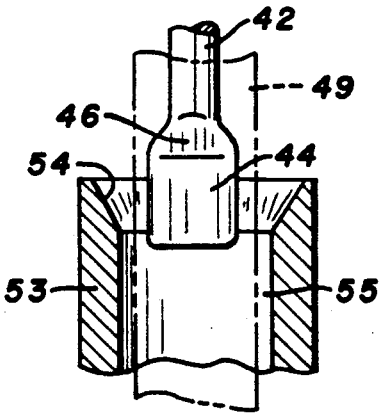
FIG. 7 is a sectional view taken along the line 7—7 of FIG. 4.
Figure 9:
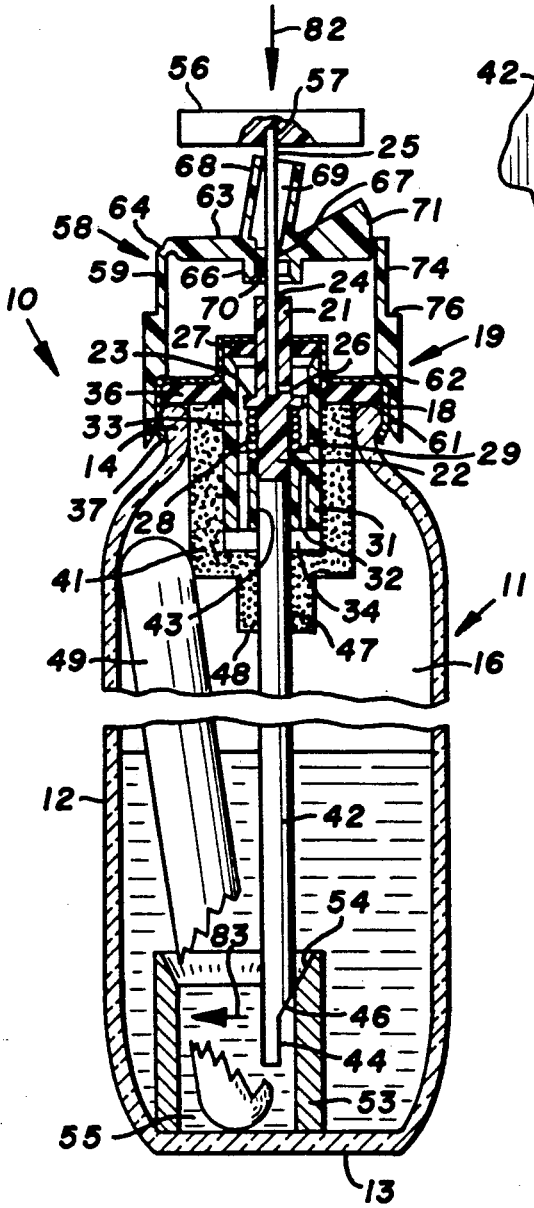
FIG. 9 is a foreshortened sectional view similar to FIG. 4 showing the breaking of the ampule.

As shown in FIGS. 1, 4, and 9, actuator member 58 has a generally cylindrical housing 59 having an inner groove 61 adjacent the lower end of the housing providing an inwardly directed annular shoulder 62. Housing 59 is mounted on the top of cap 18. The outer side and top surfaces of cap 18 engage the inner surface of groove 61 and shoulder 62 in a tight fitting relation to hold actuator member 58 on container 11. A disc 63 is hinged at 64 to the top edge of housing 59. Hinge 64 allows disc 63 to pivot about the top edge of housing 59 in an up and down direction as indicated by arrow 78 in FIG. 1. Disc 63 has an upwardly directed tubular nozzle 68 having an internal passage 69. The bottom of disc 63 has a centrally located bore 67 that is open to passage 69. As shown in FIG. 6, an annular flange 66 attached to the bottom of disc 63 surrounds bore 67. Flange 66 telescopes over the top of stem 21 to align the passage 24 of stem 21 with bore 67 and nozzle passage 69. A lip 70 extending inwardly from flange 66 is used as a stop to limit the outward movement of stem 21 through bore 67.

As shown in FIG. 3, the top of disc 63 has a generally triangular tab 71 having laterally spaced grips 72. Tab 71 is used to apply a force as indicated by arrow 79 in FIG. 4 in a generally downward direction on disc 63. This force 79 moves disc 63 downwardly into the cavity of housing 59, as indicated by arrow 80 and shown in broken lines in FIG. 4. When tab 71 is depressed, lip 70 engages the top of stem 21 and moves stem 21 down into container 11. This opens control valve 19 allowing the mixed materials and propellant to flow out of nozzle 68 and be dispensed as a foam, spray, mousse or jet to a desired location. Other types of actuator members and discharge nozzles can be used with stem 21 to open control valve 19 and direct the aerosol foam spray to desired locations.

Dispenser 10 is stored and transported in the manner shown in FIG. 1. A cup-shaped protective cover 73 can be placed over button 56 and fitted on actuator member 58. Housing 59 has an outer groove 74 adjacent the upper end of the housing providing an outwardly directed shoulder 76. The inner side and bottom surfaces of cover 73 engage the inner surface of groove 74 and shoulder 76 in a tight fitting relation to hold the cover on actuator member 58. Cover 73 snaps on actuator member 58 when a downward force, indicated by arrow 77 in FIG. 1, is applied to the top of the cover. Control valve 19 is closed thereby confining material 17 and propellant under pressure to chamber 16. Ampule 49 being a hermetically sealed vessel, separated and isolates material 52 from material 17 and propellant in chamber 16. This substantially increases the shelf life of materials 17 and 52 and minimizes deterioration of the seal materials of control valve 19. The separation of the first and second materials also allows the dispenser to use hair care products, such as hair permanents, hair relaxers, and hair dye.

Sleeve 53 and sealed ampule 49 containing material 52 are placed in chamber 16 through the top opening before cap 18 is attached to rim 14. Cap 18 and control valve 19 are placed on top of container as a unit. Push rod 42 extends down into chamber 16 to locate finger 44 within the top of sleeve 53 adjacent the side of ampule 49. Material 17 can be placed in chamber before cap 18 is placed on container 11. Propellant can be introduced into chamber 16 through stem 21 by opening valve 19 without breaking ampule 49.

In use the operator applies force 82 on button 56 to move stem 21 down into container 11. This opens control valve 19 and moves push rod 42 down into sleeve 53. Rod 25 mounted on the upper end of stem 21 prevents material and propellant under pressure in chamber 16 from being discharged from stem 21. Shoulder 46 engages beveled edge 54 of sleeve 53 to force push rod 42 laterally to break ampule 49, as shown in FIG. 9. Material 52 in ampule 49 mixes with material 17. Button 56 and rod 25 are removed from the stem 21 and actuator member 58. Dispenser 10 is now ready for use to dispense a foam, spray or jet of mixed materials and propellant to a desired location.

Figure 10:
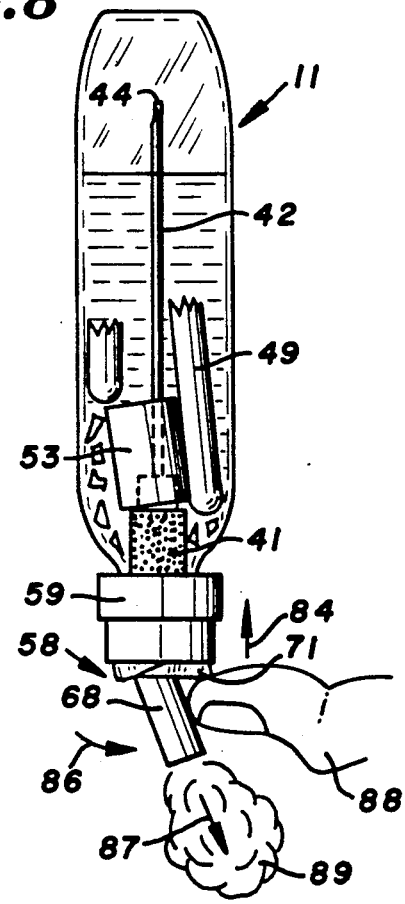
FIG. 10 is a side view showing use of the aerosol foam dispenser of FIG. 9.

To dispense a foam or mousse of mixed materials and propellant the operator inverts dispenser 10, as shown in FIG. 10, and directs nozzle 68 of actuator member 58 toward an area of desired application. Sleeve 53 moves along push rod 42 toward filter 41 allowing the materials and propellant to mix thoroughly. Filter 41 prevents the glass particles of broken ampule 49 from entering valve 19. Thumb 88 of the operator is used to apply a force indicated by arrow 84 on tab 71. Force 84 causes nozzle 68 to swing in a lateral direction as shown by arrow 86 and moves stem 21 into the container 11. This opens control valve 19 and allows foam spray 89 to be dispensed in an outward direction indicated by arrow 87 to the area of desired application, such as the hair of a person.

Figure 11:
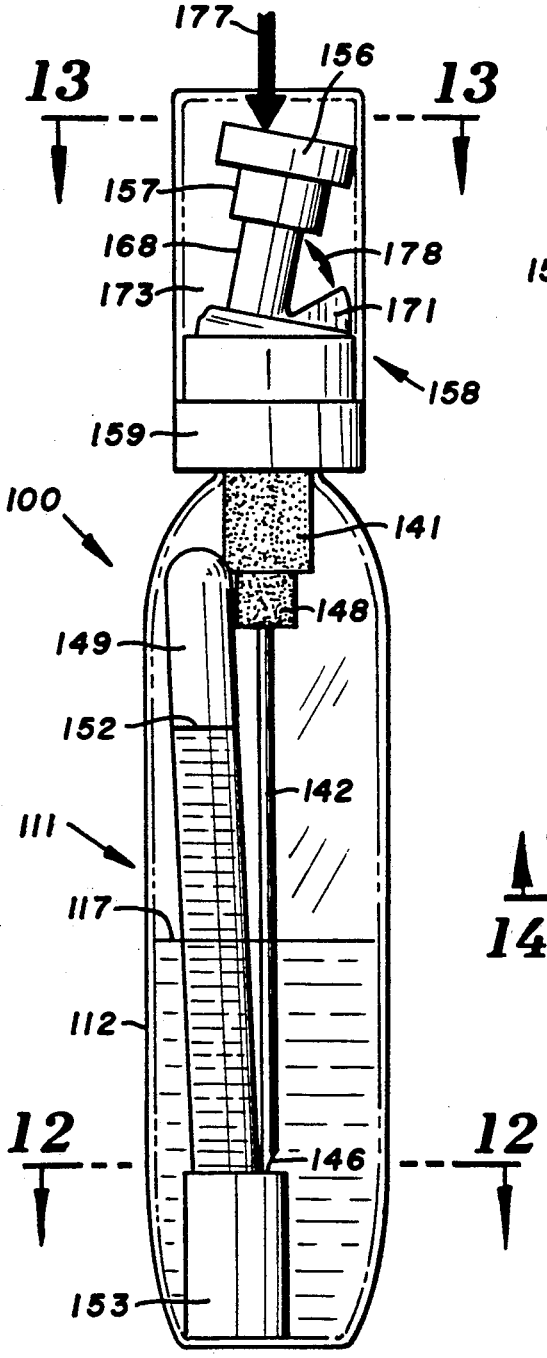
FIG. 11 is a side elevational view of a modification of the aerosol foam dispenser of the invention.
Figure 12:
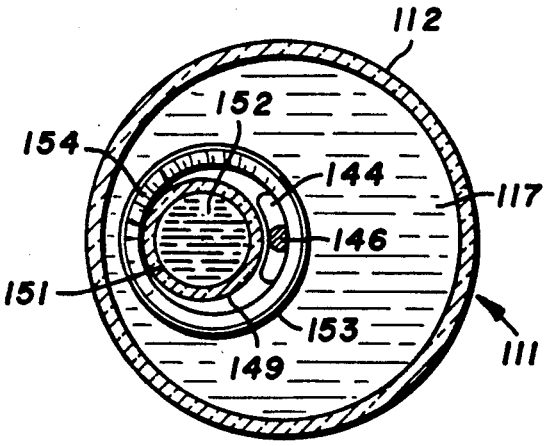
FIG. 12 is an enlarged sectional view taken along line 12—12 of FIG. 11.
Figure 13:
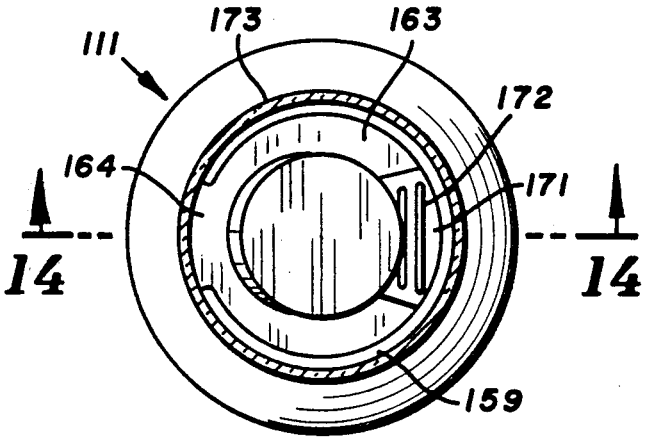
FIG. 13 is an enlarged sectional view taken along line 12—12 of FIG. 11.

Referring to FIGS. 11, 12, and 13, there is shown a modification of the aerosol dispenser 100 of the invention for delivering mixed materials with a propellant to a desired location. The parts of dispenser 100 that correspond to parts of dispenser 10 have the same reference numbers with the prefix 1. The materials within dispenser 100 are mixed immediately prior to use so that the effectiveness of the materials is not reduced. Dispenser 100 and the separate materials therein have substantial shelf life since there is little or no reaction within the container prior to the mixing of the materials within the container. Dispenser 100 can be used with materials such as hair permanents, hair relaxers, hair dyes, hair sunscreens, hair stylers and shampoos hereinafter described.

Dispenser 100 has an external bottle or container 111 made out of transparent material, such as glass, plastic or the like. Bottle 111 has a cylindrical side wall 112 joined to a generally flat bottom wall 113. The top of side wall 112 has an annular rim or bead 114 surrounding an opening or mouth into chamber 116 of container 111. A material 117, such as a liquid, is normally stored in chamber 116 along with a propellant which maintains material 117 under pressure within chamber 116. Side wall 112 of container 111 has sufficient structural strength to accommodate the pressure of the propellant in chamber 116. The open top of container 111 is closed with a cap 118 that supports a normally closed control valve indicated generally at 119.

Figure 14:
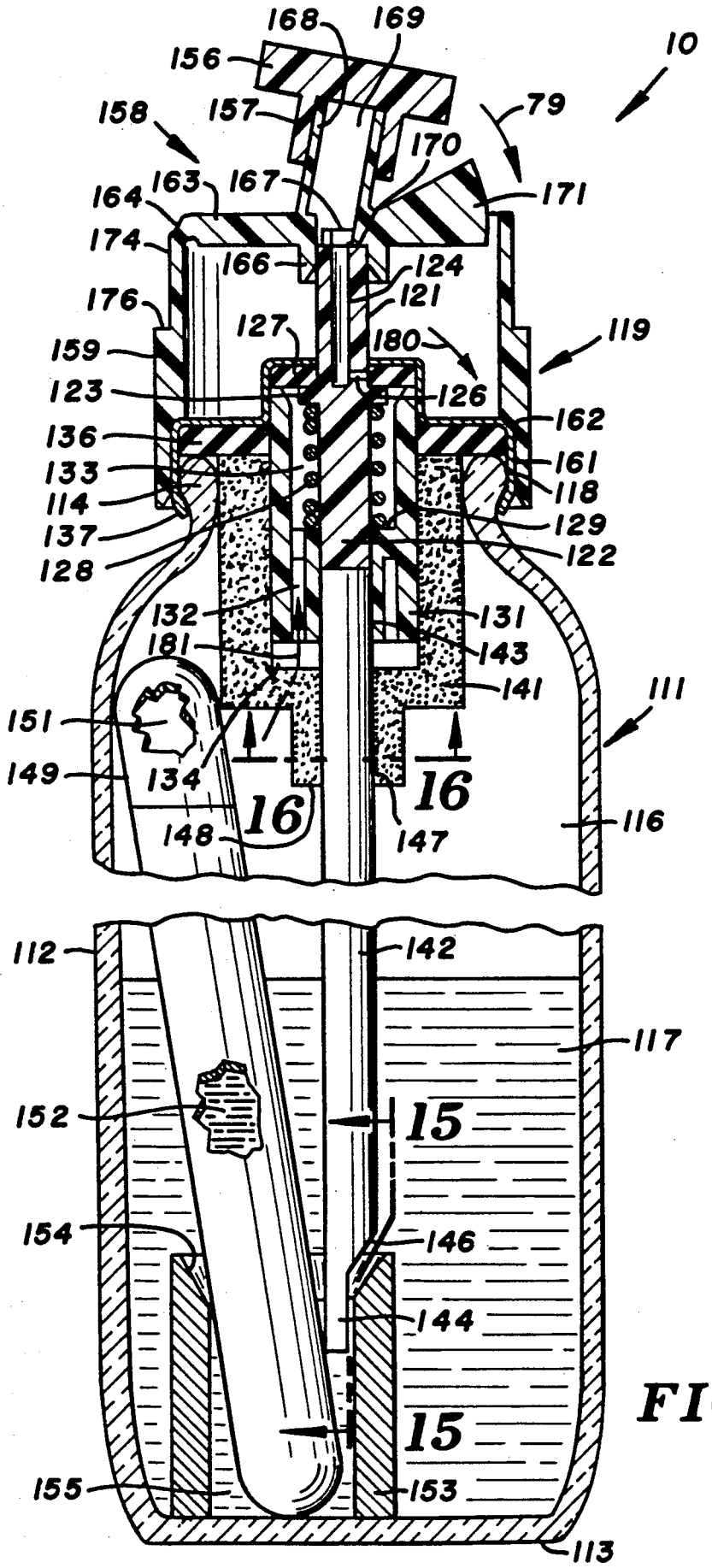
FIG. 14 is an enlarged foreshortened sectional view taken along line 14—14 of FIG. 13.

As shown in FIG. 14, control valve 119 has a generally upright tubular stem 121 that projects upwardly from cap 118. The lower portion of stem 121 has an elongated body 122 having an outwardly directed annular flange 123. Stem 121 has a passage 124 open to the top to the stem and open to a side port 126 that allows the propellant and the material to flow into passage 124 and passage 169 of a nozzle 168. An annular diaphragm 127 surrounding stem 121 is normally aligned with side port 126 to maintain valve 119 in a closed position. A coil spring 128 engages flange 123 to hold stem 121 in an up or closed position. The lower or inner end of coil spring 128 bears against an annular step 129 of a generally cup-shaped housing 131 that surrounds body 122. Housing 131 has lower passages 132 that are in communication with an internal or upper chamber 133 allowing the propellant and material to flow upwardly into chamber 133, as indicated by arrow 181 in FIG. 14, and to side port 126 when control valve 119 is in the open position. Spring 128 biases stem 121 in a closed position as shown in FIG. 14. A tubular filter 141 surrounds the lower end of housing 131. Filter 141 has a cylindrical inside wall positioned in tight fit relation around housing 131 and an outside wall engageable with bead 114 to retain filter 141 on housing 131. The upper end of filter 141 bears against a gasket 136 clamped on bead 114 with cap 118. Propellant and the material flow through filter 141 into bottom chamber 134 before entering passages 132 of valve housing 131. The filter 141 prevents particulates, such as glass particles and the like, from flowing into control valve 119 and being dispensed from the dispenser. Filter 141 is a porous polyethylene generally cylindrical member. Other types of materials can be used for filter 141. The pore size of filter 141 is in the range of 145 to 175 microns. The bottom of filter 141 has a cylindrical shaped boss 148 having a smaller diameter than the diameter of the top portion to the filter. Other types of filters can be used to prevent foreign particles from interfering with the operation of control valve 119. Annular gasket 136 of compressible material surrounds housing 131 and bears against the top of bead 114 of container 111. Cap 118 has a clamp ring 137 that is turned about or clamped over gasket 136 and bead 114 to seal cap 118 on container 111.

Figure 18:
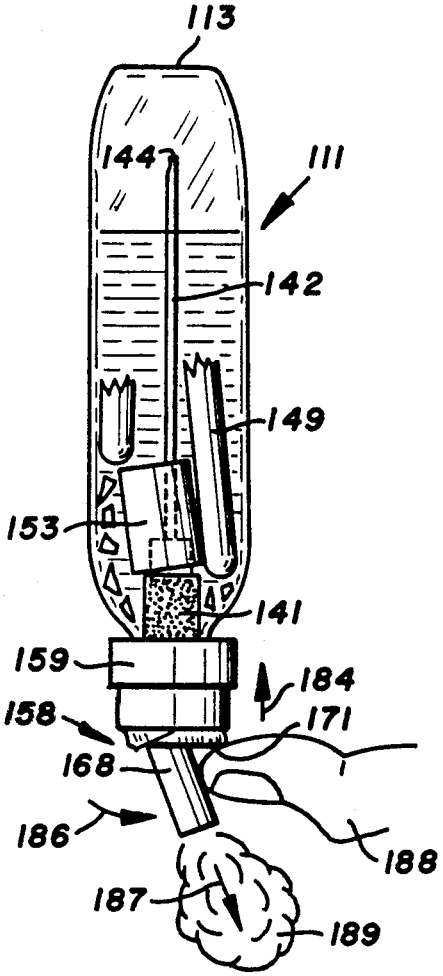
FIG. 18 is a side view showing use of aerosol foam dispenser of FIG. 17.
Figure 19:
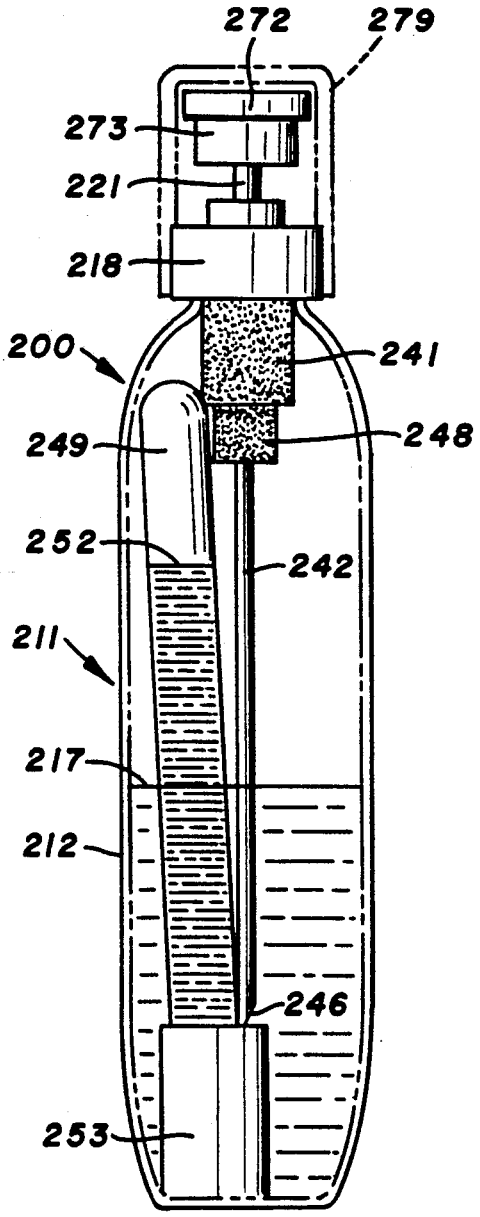
FIG. 19 is a side elevational view of a second modification of the aerosol dispenser of the invention.
Figure 20:
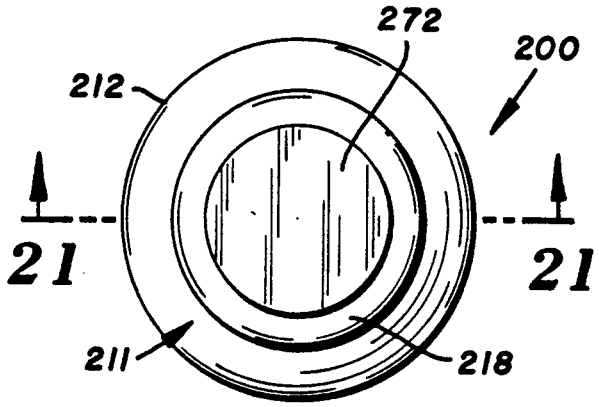
FIG. 20 is an enlarged top view of the dispenser of FIG. 19.

The lower portion of body 122 engages a downwardly directed compression or push rod 142. Push rod 142 is an elongated rigid member having a smooth outer cylindrical surface slidably retained on housing 131 so that rod 142 can move with stem 121. Rod 142 is a stainless steel wire rod having a continuous and smooth cylindrical outer surface. Other types of rigid materials can be used to make rod 142. The upper end of rod 142 fits into a hole or recess 143 in the bottom of housing 131. Rod 142 extends downwardly through a hole 147 in boss 148 of filter 141. Rod 142 has a close sliding fit relation with boss 148 to prevent foreign particles from entering passages 132, as shown in FIG. 18. Filter 141 supports and guides push rod 142. Spring 128 also serves as a stop to limit the depression or inward movement of stem 121. Body 122 has a diameter that is smaller than the diameter of chamber 133 so that the propellant and material can freely flow to side port 126 when port 126 is moved below diaphragm 127 to allow the material to flow through the valve 119 and nozzle 168 and be dispensed to a desired location.

Figure 15:
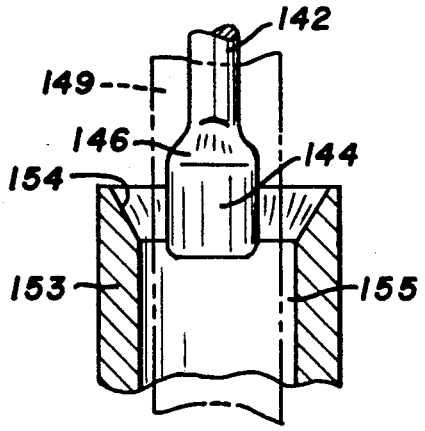
FIG. 15 is a sectional view taken along line 15—15 of FIG. 14.
Figure 16:
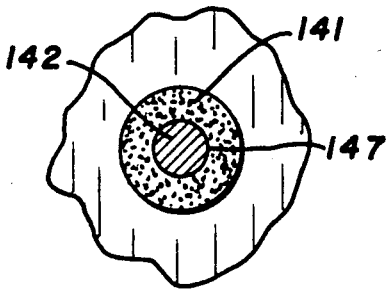
FIG. 16 is a sectional view taken along line 16—16 of FIG. 14.

As shown in FIGS. 12, 14, and 15, the bottom of push rod 142 has a downwardly directed convex curved finger 144. Finger 144 has a width less than one half the diameter of rod 142. Finger 144 is located adjacent a wedge or shoulder 146 on the lower end of rod 142. Shoulder 146 is preferably at an angle of 45 degrees relative to the longitudinal axis of rod 142. Other angles can be used for wedge shoulder 146. Finger 144 extends downwardly generally parallel to the longitudinal axis of rod 142. The upper end of finger 144 has opposite side edges that diverge upwardly to the opposite side edges of shoulder 146. The lower side edges of finger 144 curve inwardly toward each other and engage the inner surface of a sleeve 153 when control valve 119 is in its closed position.

An elongated cylindrical frangible ampule or vial 149 having a sealed chamber 151 storing a second material 152, such as liquid, chemical, powders, and the like, that is desired to be mixed with material 117 in chamber 116 immediately prior to use of the dispenser. Ampule 149 is made of breakable material, such as a glass vessel located generally along the length of chamber 116. This position of ampule 119 allows a relatively large ampule to be located within chamber 116 so that a wide range of ratios of amounts of materials can be mixed in chamber 116. The diameter of ampule 149 is smaller than the diameter of the opening into chamber 116 to allow it to be placed in chamber 116. The length of ampule 149 can be substantially the same as the longitudinal length of chamber 116. The size of ampule 149 is selected to provide the desired ratio of volumes of material 117 to material 152.

Ampule 149 is retained in its generally upright or longitudinal position with a cylindrical sleeve or holding member 153. Sleeve 153 rests on bottom wall 113 of container 111 and has a passage 155 that accommodates a lower end of ampule 149. Sleeve 153 is a one-piece cylindrical member having an outside diameter slightly smaller than the opening into chamber 116 whereby sleeve 153 can be placed into chamber 116. As seen in FIG. 14, sleeve 153 has an inwardly directed annular chamfer or beveled edge 154 at the top end thereof. Preferably, the angle of edge 154 is at 45 degrees relative to the longitudinal axis of passage 155 of sleeve 153. Other angles can be used for edge 154. Sleeve 153 has open top and bottom ends so that material is not trapped in passage 155. Finger 144 is located in the upper end of sleeve 153 when valve 119 is in the closed position. Wedge shoulder 146 is spaced from edge 154. Finger 144 is located contiguous to the side wall of ampule 149. Ampule 149 is not broken so that material 152 therein is isolated from material 117 in chamber 116. The structural condition of ampule 149 and contents of container 111 can be visually observed through the transparent side wall 112 of container 111.

Figure 17:
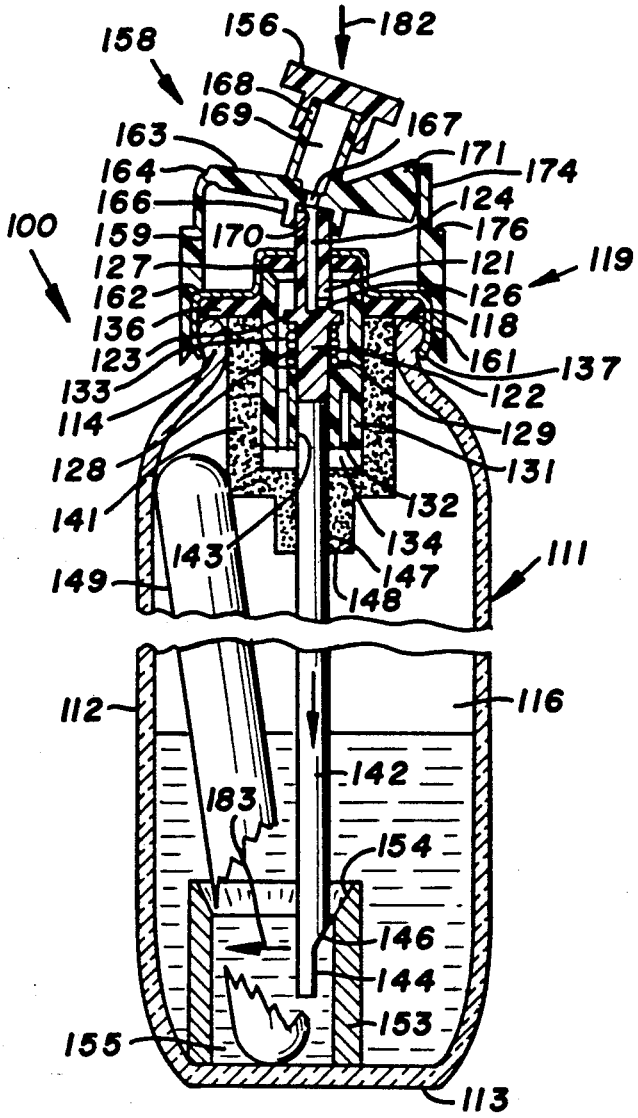
FIG. 17 is a foreshortened sectional view similar to FIG. 14 showing the breaking of the ampule.

As shown in FIGS. 14 and 17, the upper end of stem 121 fits into a hole or bore in a nipple 166 joined to the bottom of a swinging disc 164. An upright tubular nozzle 168 joined to the top of disc 164 has a discharge passage 169 for directing the mixed materials and propellant to a selected location. The top of stem 121 bears against a shoulder or stop 170 at the base of the hole in nipple 166 to prevent the stem from moving up into passage 169 and allow disc 163 to move stem 121 down into container chamber 116. A round button or cap 156 having a tubular sleeve 157 is mounted on the outer end of nozzle 168. Nozzle 168 fits into the blind bore in sleeve 157 so that cap 156 closes passage 169. Cap 156 can have a finger that fits into passage 169 in lieu of sleeve 157 to close passage 169.

Button 156 is used to apply force, as indicated by arrow 182 in FIG. 17, in a downward direction on stem 121. This moves valve 119 to the open position and push rod 142 in a downward direction. Cap 156 prevents the materials and propellant under pressure in chamber 116 from being discharged from stem 121 and nozzle 168. The wedge shoulder 146 engages edge 154 causing the lower end of rod 142 to move laterally into tight engagement with the side of ampule 149. Continued downward movement of push rod 142 continues to exert lateral force on the ampule 149 and wedges the lower end of push rod 142 between the inside of the wall of sleeve 153 and ampule 149. The force of push rod 142 against ampule 149, indicated by arrow 183 in FIG. 17, fractures or breaks ampule 149 thereby releasing material 152 into chamber 116 where it is mixed with material 117. The mixing of the materials 117 and 152 can be facilitated by shaking dispenser 100. Sleeve 153 is free to move up and down the length of push rod 142. This allows materials in passage 155 to be thoroughly mixed with all of the material in chamber 116. As soon as ampule 149 is broken, the external force 182 on cap 156 can be removed. Spring 128 will then move stem 121 to its closed position as shown in FIG. 14. Cap 156 is then removed from nozzle 168. An actuator member, indicated generally at 158, then can be used to open control valve 119 and direct the aerosol foam, spray, or mousse to desired locations.

As shown in FIGS. 11, 14, and 17, actuator member 158 has a generally cylindrical housing 159 having an inner groove 161 adjacent the lower end of the housing providing an inwardly directed annular shoulder 162. Housing 159 is mounted on the top of cap 118. The outer side and top surfaces of cap 18 engage the inner surface of groove 161 and shoulder 162 in a tight fitting relation to hold actuator member 158 on container 111. Disc 163 is hinged at 164 to the top edge of housing 159. Hinge 164 allows disc 163 to pivot about the top edge of housing 159 in an up and down direction as indicated by arrow 178 in FIG. 11. The bottom of disc 163 has a centrally located bore 67 that is open to passage 169, passage 124 of stem 121. A lip 170 extending inwardly from bore 167 is used as a stop to limit the outward movement of stem 121 through bore 167.

As shown in FIG. 13, the top of disc 163 has a generally triangular tab 171 having laterally spaced finger grips 172. Tab 171 is used to apply a force as indicated by arrow 179 in FIG. 14 in a generally downward direction on disc 163. This force 179 moves disc 163 downwardly into the cavity of housing 159, as indicated by arrow 180 and shown in broken lines in FIG. 14. When tab 171 is depressed, lip 170 engages the top of stem 121 and moves stem 121 down into container 111. This opens control valve 119 allowing the mixed materials and propellant to flow out of nozzle 168 and be dispensed as a foam, spray, mousse or jet to a desired location.

Dispenser 100 is stored and transported in the manner shown in FIG. 1. A cup-shaped protective cover 173 can be placed over cap 156 and fitted on actuator member 158. Housing 159 has an outer groove 174 adjacent the upper end of the housing providing an outwardly directed shoulder 176. The inner side and bottom surfaces of cover 173 engage the inner surface of groove 174 and shoulder 176 in a tight fitting relation to hold the cover on actuator member 158. Cover 173 snaps on actuator member 158 when a downward force, indicated by arrow 177 in FIG. 11, is applied to the top of the cover. Control valve 119 is closed thereby confining material 117 and propellant under pressure to chamber 116. Ampule 149 being a hermetically sealed vessel, separated and isolates material 152 from material 117 and propellant in chamber 116. This substantially increases the shelf life of materials 117 and 152 and minimizes deterioration of the seal materials of control valve 119. The separation of the first and second materials also allows the dispenser to use hair care products, such as hair permanents, hair relaxers, and hair dye.

Sleeve 153 and sealed ampule 149 containing material 152 are placed in chamber 116 through the top opening before cap 118 is attached to rim 114. Cap 118 and control valve 119 are placed on top of container as a unit. Push rod 142 extends down into chamber 116 to locate finger 144 within the top of sleeve 153 adjacent the side of ampule 149. Material 117 can be placed in chamber before cap 118 is placed on container 111. Propellant can be introduced into chamber 116 through stem 121 by opening valve 119 without breaking ampule 149.

In use the operator applies force 182 on cap 156 to move disc 163 and stem 121 down into container 111. This opens control valve 119 and moves push rod 142 down into sleeve 153. Rod 125 mounted on the upper end of stem 121 prevents material and propellant under pressure in chamber 116 from being discharged from stem 121. Shoulder 146 engages beveled edge 154 of sleeve 153 to force push rod 142 laterally to break ampule 149, as shown in FIG. 17. Material 152 in ampule 149 mixes with material 117. Cap 156 is removed from nozzle 168. Dispenser 100 is now ready for use to dispense a foam, spray, mousse or jet of mixed materials and propellant to a desired location.

To dispense a foam of mixed materials and propellant the operator inverts dispenser 100, as shown in FIG. 18, and directs the nozzle 168 of actuator member 158 toward an area of desired application. Sleeve 153 moves along push rod 142 toward filter 141 allowing the materials and propellant to mix thoroughly. Filter 141 prevents the glass particles of broken ampule 149 from entering control valve 119. Thumb 188 of the operator is used to apply a force indicated by arrow 184 on tab 171. Force 184 causes nozzle 168 to swing in a lateral direction as shown by arrow 86 and moves stem 121 into the container 111. This opens control valve 119 and allows foam, spray, or the like 189 to be dispensed in an outward direction indicated by arrow 87 to the area of desired application, such as the hair of a person.

Referring to FIGS. 19 to 22, there is shown a second modification of the aerosol dispenser 200 of the invention for delivering mixed materials with a propellant to a desired location. The parts of dispenser 200 that correspond to parts of dispenser 10 have the same reference numbers with the prefix 2. The materials within dispenser 200 are mixed immediately prior to use so that the effectiveness of the materials is not reduced. Dispenser 200 and the separate materials therein have substantial shelf life since there is little or no reaction within the container prior to the mixing of the materials within the container. Dispenser 200 can be used with materials such as hair permanents, hair relaxers, hair dyes, hair sunscreens, hair stylers and shampoos hereinafter described.

Dispenser 200 has an external bottle or container 211 made out of transparent material, such as glass, plastic or the like. Bottle 211 has a cylindrical side wall 212 joined to a generally flat bottom wall 213. The top of side wall 212 has an annular rim or bead 214 surrounding an opening or mouth into chamber 216 of container 211. A material 217, such as a liquid, is normally stored in chamber 216 along with a propellant which continuously maintains material 217 under pressure within chamber 216. Side wall 212 of container 211 has sufficient structural strength to accommodate the pressure of the propellant in chamber 216. The open top of container 211 is closed with a cap 218 that supports a normally closed control valve indicated generally at 219.

Figure 21:
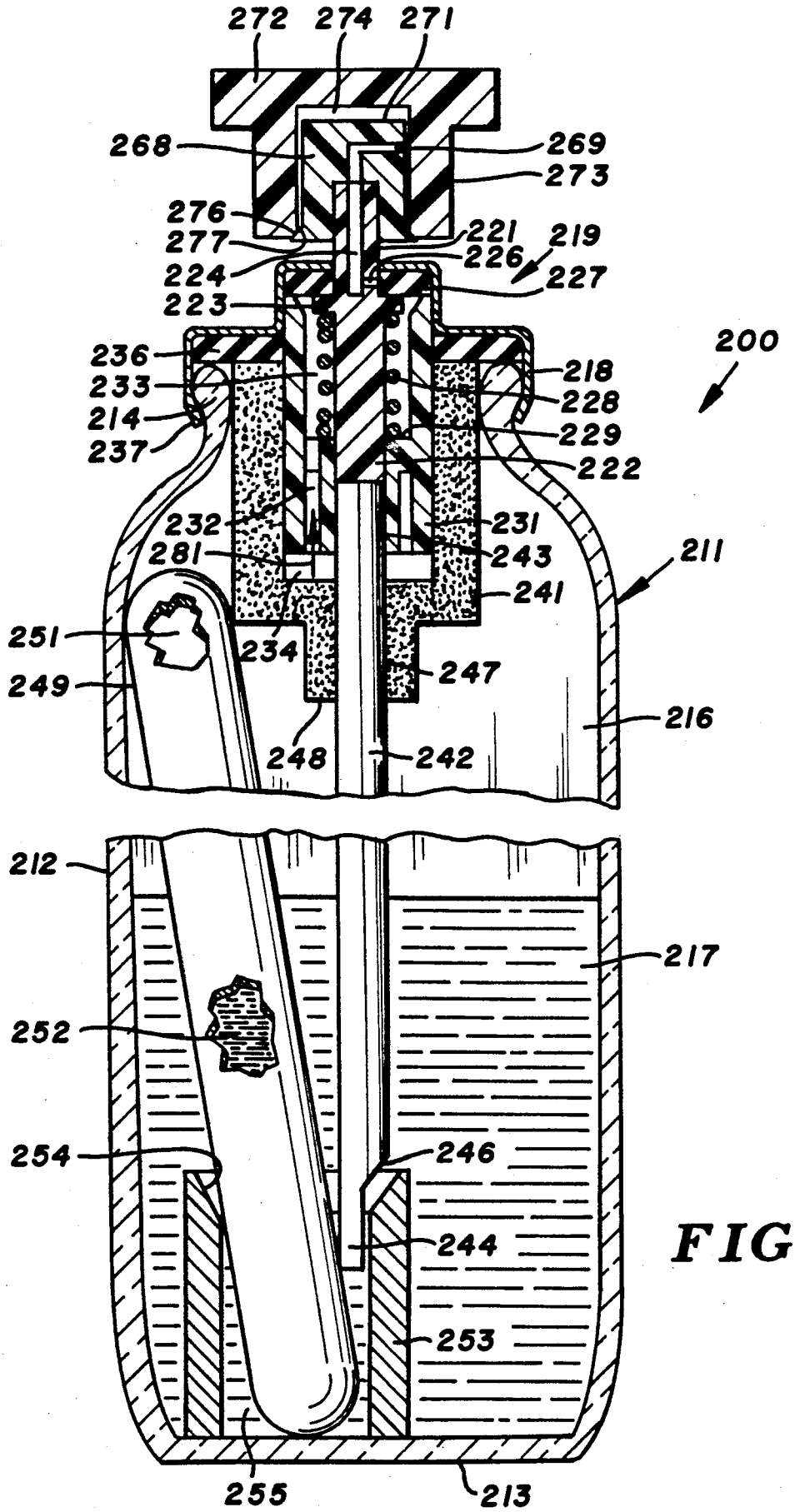
FIG. 21 is a sectional view taken along the line 21—21 of FIG. 20.

As shown in FIG. 21, control valve 219 has a generally upright tubular stem 221 that projects upwardly from cap 218. The lower portion of stem 221 has an elongated body 222 having an outwardly directed annular flange 223. Stem 221 has a passage 224 open to the top to the stem and open to a side port 226 that allows the propellant and the material to flow into passage 224 and passage 269 of a nozzle 268 mounted on the outer end of stem 221. An annular diaphragm 227 surrounding stem 221 is normally aligned with side port 226 to maintain valve 219 in a closed position. A coil spring 228 engages flange 223 to hold stem 221 in an up or closed position. The lower or inner end of coil spring 228 bears against an annular step 229 of a generally cup-shaped housing 231 that surrounds body 222. Housing 231 has lower passages 232 that are in communication with an internal or upper chamber 233 allowing the propellant and material to flow upwardly into chamber 233, as indicated by arrow 281 in FIG. 21, and to side port 226 when control valve 219 is in the open position. Spring 228 biases stem 221 in a closed position as shown in FIG. 21. A tubular filter 241 surrounds the lower end of housing 231. Filter 241 has a cylindrical inside wall positioned in tight fit relation around housing 231 and an outside wall engageable with bead 214 to retain filter 241 on housing 231. The upper end of filter 241 bears against a gasket 236 clamped on bead 214 with cap 218. Propellant and the material flow through filter 241 into bottom chamber 234 before entering passages 232 of valve housing 231. The filter 241 prevents particulates, such as glass particles and the like, from flowing into control valve 219 and being dispensed from the dispenser. Filter 241 is a porous polyethylene generally cylindrical member. Other types of materials can be used for filter 241. The pore size of filter 241 is in the range of 245 to 275 microns. The bottom of filter 241 has a cylindrical shaped boss 248 having a smaller diameter than the diameter of the top portion to the filter. Other types of filters can be used to prevent foreign particles from interfering with the operation of control valve 219. Annular gasket 236 of compressible material surrounds housing 231 and bears against the top of bead 214 of container 211. Cap 218 has a clamp ring 237 that is turned about or clamped over gasket 236 and bead 214 to seal cap 218 on container 211.

Figure 22:
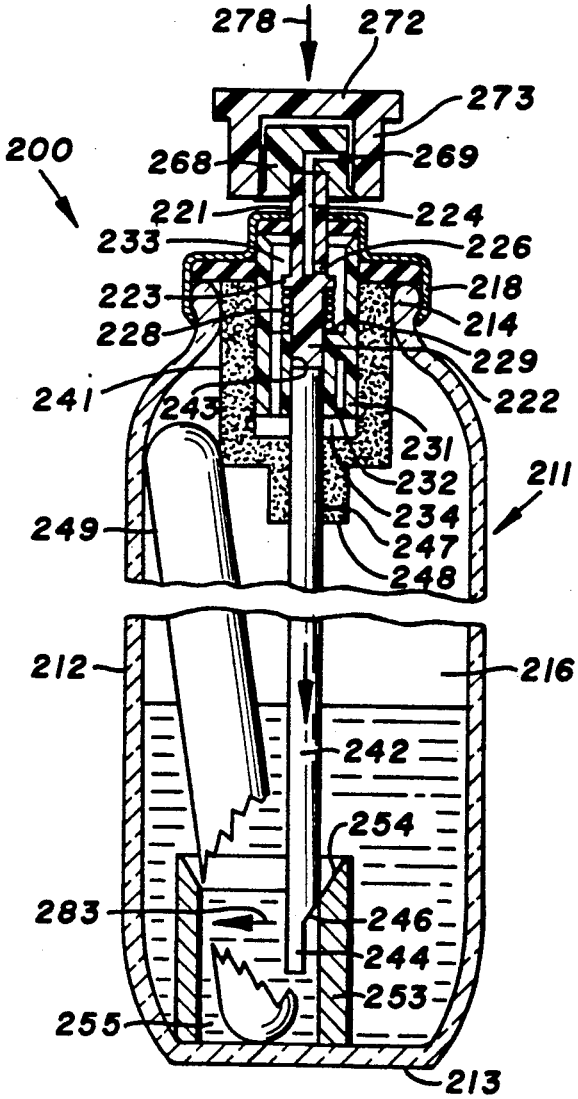
FIG. 22 is a sectional view similar to FIG. 21 showing the dispenser with a broken ampule.

The lower portion of body 222 engages a downwardly directed compression or push rod 242. Push rod 242 is an elongated rigid member having a smooth outer cylindrical surface slidably retained on housing 231 so that rod 242 can move with stem 221. Rod 242 is a stainless steel wire rod having a continuous and smooth cylindrical outer surface. Other types of rigid materials can be used to make rod 242. The upper end of rod 242 fits into a hole or recess 243 in the bottom of housing 231. Rod 242 extends downwardly through a hole 247 in boss 248 of filter 241. Rod 242 has a close sliding fit relation with boss 248 to prevent foreign particles from entering passages 232, as shown in FIG. 22. Filter 241 supports and guides push rod 242. Spring 228 also serves as a stop to limit the depression or inward movement of stem 221. Body 222 has a diameter that is smaller than the diameter of chamber 233 so that the propellant and material can freely flow to side port 226 when port 226 is moved below diaphragm 227 to allow the material to flow through the valve 219 and nozzle 268 and be dispensed from passage 269 to a desired location.

As shown in FIGS. 21 and 22, the bottom of push rod 242 has a downwardly directed convex curved finger 244. Finger 244 has a width less than one half the diameter of rod 242. Finger 244 is located adjacent a wedge or shoulder 246 on the lower end of rod 242. Shoulder 246 is preferably at an angle of 45 degrees relative to the longitudinal axis of rod 242. Other angles can be used for wedge shoulder 246. Finger 244 extends downwardly generally parallel to the longitudinal axis of rod 242. The upper end of finger 244 has opposite side edges that diverge upwardly to the opposite side edges of shoulder 246. The lower side edges of finger 244 curve inwardly toward each other and engage the inner surface of a sleeve 253 when control valve 219 is in its closed position.

An elongated cylindrical frangible ampule or vial 249 having a sealed chamber 251 storing a second material 252, such as liquid, chemical, powders, and the like, that is desired to be mixed with material 217 in chamber 216 immediately prior to use of the dispenser. Ampule 249 is made of breakable material, such as a glass vessel located generally along the length of chamber 216. This position of ampule 219 allows a relatively large ampule to be located within chamber 216 so that a wide range of ratios of amounts of materials can be mixed in chamber 216. The diameter of ampule 249 is smaller than the diameter of the opening into chamber 216 to allow it to be placed in chamber 216. The length of ampule 249 can be substantially the same as the longitudinal length of chamber 216. The size of ampule 249 is selected to provide the desired ratio of volumes of material 217 to material 252.

Ampule 249 is retained in its generally upright or longitudinal position with a cylindrical sleeve or holding member 253. Sleeve 253 rests on bottom wall 213 of container 211 and has a passage 255 that accommodates a lower end of ampule 249. Sleeve 253 is a one-piece cylindrical member having an outside diameter slightly smaller than the opening into chamber 216 whereby sleeve 253 can be placed into chamber 216. As seen in FIG. 21, sleeve 253 has an inwardly directed annular chamfer or beveled edge 254 at the top end thereof. Preferably, the angle of edge 254 is at 45 degrees relative to the longitudinal axis of passage 255 of sleeve 253. Other angles can be used for edge 254. Sleeve 253 has open top and bottom ends so that material is not trapped in passage 255. Finger 244 is located in the upper end of sleeve 253 when valve 219 is in the closed position. Wedge shoulder 246 is spaced from edge 254. Finger 244 is located contiguous to the side wall of ampule 249. Ampule 249 is not broken so that material 252 therein is isolated from material 217 in chamber 216. The structural condition of ampule 249 and contents of container 211 can be visually observed through the transparent side wall 212 of container 211.

As shown in FIGS. 21 and 22, the upper end of tubular stem 221 fits into a hole or bore in the bottom of nozzle 268 to align passage 224 with discharge passage or orifice 269. Nozzle 268 has a generally flat top 271 so that it can be depressed with a finger or thumb to open valve 219. An inverted cup-shaped button or cap 272 is mounted on nozzle 268 to prevent propellant and material from being dispensed from nozzle 268 during the breaking of ampule 249. Cap 272 has a tubular sleeve 273 having a blind bore 274 accommodating nozzle 268. The lower end of sleeve 273 has an internal face or annular edge 276 in sealing engagement with an outwardly directed shoulder 277 on the lower end of nozzle 268. Shoulder 277 can taper outwardly to frictionally engage annular edge 276. Shoulder 277 can be a radial annular flange that engages the bottom of sleeve 273. Cap 272 can be removed from nozzle 268 without pulling nozzle off of stem 221.

Cap 272 is used to apply force, as indicated by arrow 278 in FIG. 22, in a downward direction on nozzle 268. This moves stem 221 and valve 219 to the open position and forces push rod 242 in a downward direction. Cap 272 prevents the materials and propellant under pressure in chamber 216 from being discharged from nozzle 268. Wedge shoulder 246 engages edge 254 causing the lower end of rod 242 to move laterally into tight engagement with the side of ampule 249. Continued downward movement of push rod 242 continues to exert lateral force on ampule 249 and wedges the lower end of push rod 242 between the inside of the wall of sleeve 253 and ampule 249. The force of push rod 242 against ampule 249, indicated by arrow 283 in FIG. 22, fractures or breaks ampule 249 thereby releasing material 252 into chamber 216 where it is mixed with material 217. The mixing of the materials 217 and 252 can be facilitated by shaking dispenser 200. Sleeve 253 is free to move up and down the length of push rod 242. This allows materials in passage 255 to be thoroughly mixed with all of the material in chamber 216. As soon as ampule 249 is broken, the external force 278 on cap 272 can be removed. Spring 228 will then move stem 221 to its closed position as shown in FIG. 21. Cap 272 is then removed from nozzle 268.

Dispenser 200 is stored and transported in the manner shown in FIG. 1. A cup-shaped protective cover 279 can be placed over cap 256 and fitted on cap 218. The inside surface of the lower end of cover 279 engages the outer surface of cap 218 in a tight fitting relation to hold cover 279 on cap 218. Control valve 219 is closed thereby confining material 217 and propellant under pressure to chamber 216. Ampule 249 being a hermetically sealed vessel, separated and isolates material 252 from material 217 and propellant in chamber 216. This substantially increases the shelf life of materials 217 and 252 and minimizes deterioration of the seal materials of control valve 219. The separation of the first and second materials also allows the dispenser to use hair care products, such as hair permanents, hair relaxers, and hair dye.

Sleeve 253 and sealed ampule 249 containing material 252 are placed in chamber 216 through the top opening before cap 218 is attached to rim 214. Cap 218 and control valve 219 are placed on top of container as a unit. Push rod 242 extends down into chamber 216 to locate finger 244 within the top of sleeve 253 adjacent the side of ampule 249. Material 217 can be placed in chamber before cap 218 is placed on container 211. Propellant can be introduced into chamber 216 through stem 221 by opening valve 219 without breaking ampule 249.

In use the operator applies force 278 on cap 256 to move nozzle 268 and stem 221 down into container 211. This opens control valve 219. Continued movement of push rod 242 forces finger 244 down into sleeve 253. Cap 272 mounted on nozzle 268 prevents material and propellant under pressure in chamber 216 from being discharged from nozzle 268 into the atmosphere. Shoulder 246 engages beveled edge 254 of sleeve 253 to force push rod 242 laterally to break ampule 249, as shown in FIG. 22. Material 252 in ampule 249 mixes with material 217. Cap 256 is removed from nozzle 268. Dispenser 200 is now ready for use to dispense a foam, spray, mousse or jet of mixed materials and propellant to a desired location.

To dispense a foam of mixed materials and propellant the operator inverts dispenser 200 and directs nozzle 268 toward an area of desired application. Sleeve 253 moves along push rod 242 toward filter 241 allowing the materials and propellant to mix thoroughly. Filter 241 prevents the glass particles of broken ampule 249 from entering control valve 219. The thumb of the operator can be used to apply a force on nozzle 268 to move stem 221 into container 211. This opens control valve 219 and allows foam, spray, or the like to be dispensed from passage 269 in an outward direction to the area of desired application, such as the hair of a person.

Figure 23:
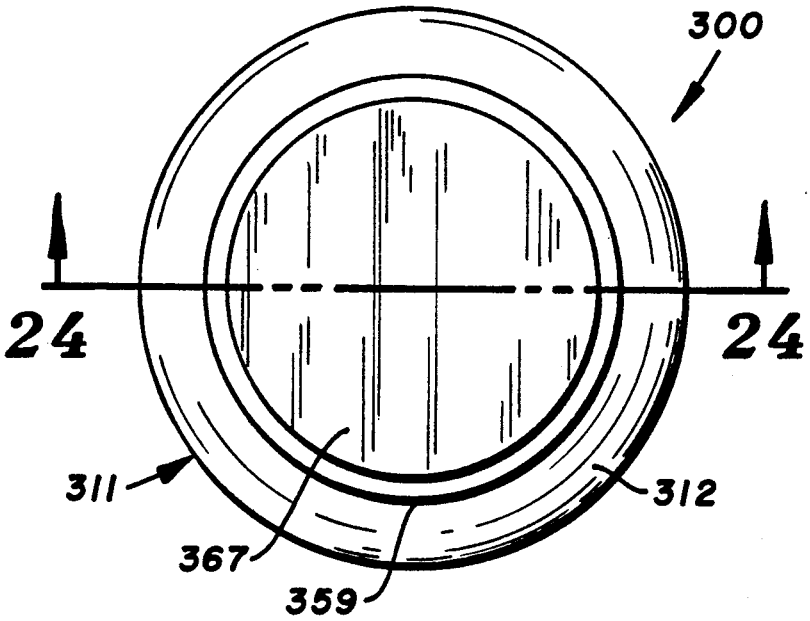
FIG. 23 is a top view of a third modification of the aerosol dispenser of the invention.
Figure 24:
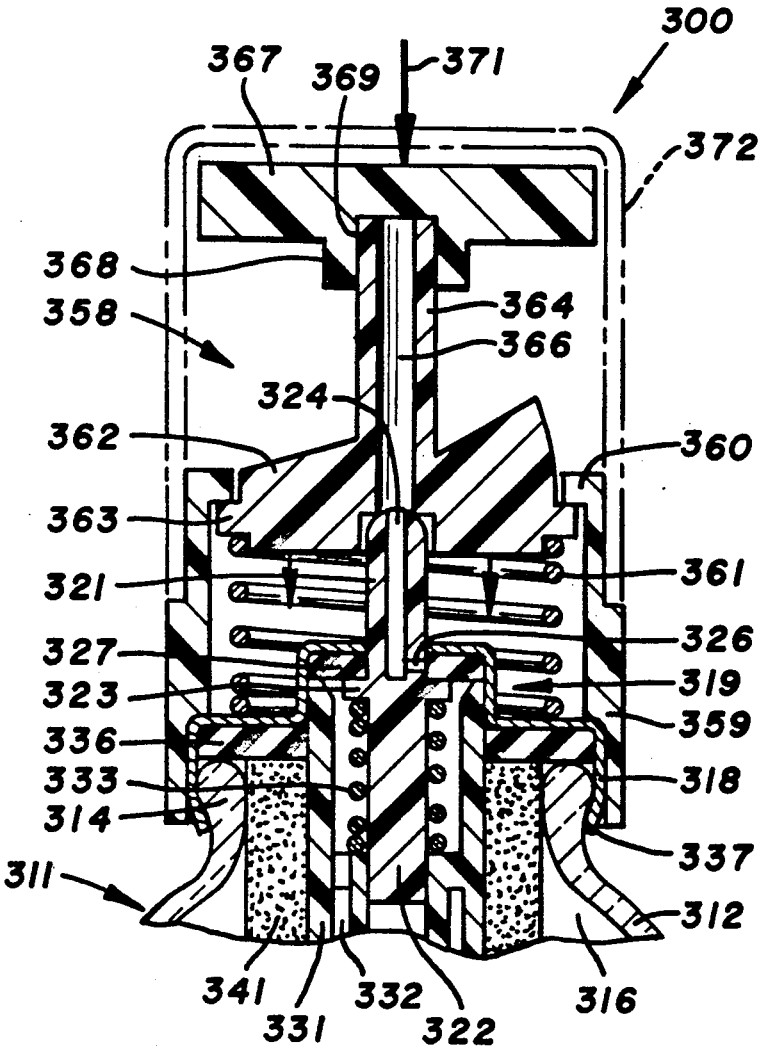
FIG. 24 is a sectional view taken along line 24—24 of FIG. 23.

Referring to FIGS. 23 and 24, there is shown a modified nozzle and cap assembly for the dispenser of the invention. The dispenser indicated at 300 has all of the parts of dispenser 10 with the same parts having the same reference number with the prefix 3. Nozzle 358 is mounted on the outer end of stem 321 with housing 359. The lower end of housing 359 is mounted on cap 318. The top end of housing 359 has an inwardly directed annular lip 360. Nozzle 358 is biased upwardly into engagement with lip 360 with a coil spring 361. Spring 361 is supported on cap 318 and surrounds valve 319.

Nozzle 358 has a body 362 having an outwardly directed flange 363 under lip 360 which allows nozzle 358 to be pressed toward container 311 to open valve 319. Lip 360 is a stop preventing outward movement and separation of nozzle 358 from housing 359. A tubular spout or nipple 364 having a passage 366 is joined to the top of nozzle body 362. Spout 364 is used to direct foam to a desired location.

A cap or button 367 is mounted on the outer end of spout 364 to prevent foam from moving through passage 366 during the breaking of the ampule and mixing of materials in chamber 316. Cap 367 has a sleeve 368 with a blind hole 369 accommodating spout 364. Hole 369 has a size about the same as the end of spout 364 whereby spout 364 has a releasable light fit with sleeve 368. A force indicated by arrow 371 is applied to cap 367 to move nozzle 358 axially into housing 359 to open valve 319 and break the ampule. The propellant and material in chamber 316 cannot escape as cap 367 closes spout passage 366.

When the ampule is broken, valve 319 is allowed to close by releasing force 371 on cap 367. Cap 367 is then removed to allow use of dispenser 300 to discharge foam from spout 364 when valve 319 is open.

A cup-shaped cover 371 fits over cap 367 and mounts on housing 359 during storage and transportation of dispenser 300.

Hair care compositions for sunscreens, conditioning and styling can be used with the dispenser of the invention. Two parts of the compositions are separately stored within the container. In use, the two or more parts of compositions are mixed by breaking the ampule. The mixed composition is dispensed as a mousse onto the human hair. Examples of hair care compositions are disclosed in U.S. Pat. Nos. 4,526,781; 4,567,038; 4,714,610; and 4,764,363. The disclosures of these patents are incorporated herein by reference.

Compositions for coloring and dyeing human hair are usually prepared in two parts. One part comprising a base ordinarily contains the dyeing or lightening aids and may include one or more oxidation dye intermediates. The second part comprising the oxidizer contains the oxidizing agent and the carrier and may include a stabilizer for the oxidizing agent. The separate parts are hand-mixed prior to use and applied to the hair. The dispenser of the invention is usable to separately store the two parts of human hair and dyeing composition and discharge or eject the mixed composition as a mousse or foam directly onto the human head and hair thereon. Examples of human hair coloring and dyeing compositions are disclosed in the following U.S. Pat. Nos. 3,743,678; 3,811,830; 3,884,627; 3,930,792; 3,950,127; 3,970,423; 3,977,826; 3,981,677; 4,021,486; 4,119,399; 4,196,145; 4,566,876; and 4,776,855. The disclosures of these patents are incorporated herein by reference.

The dispenser of the invention can be used to store, mix, and dispense as a foam or mousse two-part hair relaxer compositions. Examples of hair relaxer compositions are disclosed in U.S. Pat. Nos. 4,303,085; 4,304,244; 4,324,263; 4,373,540; 4,416,296; 4,530,830; and 4,605,018. The compositions disclosed in these patents are incorporated herein by reference.

Shampoos can be dispensed as a foam or mousse with the dispensing apparatus of the invention. The compositions of the shampoos are mixed in the container and subsequently dispensed as a mousse onto a person's hair and/or body. Examples of shampoo compositions are disclosed in U.S. Pat. Nos. 3,959,462; 3,960,782; 3,962,418; 3,990,991; 4,033,895; 4,115,548; 4,195,077; 4,379,753; 4,534,877; and 4,704,272. The compositions disclosed in these patents are incorporated herein by reference.

While there has been shown and described preferred embodiments of the aerosol foam dispenser and method of the invention, it is understood that changes in the structure, arrangement of structure, materials, and process steps may be made by those skilled in the art without departing from the invention. The invention is defined in the following claims.

I claim:

1. An aerosol dispenser comprising: a container having a bottom wall, an open top, and a chamber for storing a propellant and first material under pressure, a cap mounted on the container closing said open top, a housing extended into the chamber through said open top, said housing having a passage, control valve means mounted on the cap and housing operable to control the flow of propellant and materials from said passage, said control valve means being normally closed and having a moveable member extended into the passage which can be moved to open said valve means whereby propellant and materials are dispensed from the container, a porous filter mounted on the housing to prevent foreign particles from flowing into the passage whereby when said valve means is open the propellant and materials in said chamber flow through the filter into the passage, frangible ampule means located within said chamber storing a second material separate from the first material until the ampule means is broken, annular means located in said chamber having a passage accommodating a portion of the ampule means, push rod means connected to the moveable member extended through the filter into said passage of the annular means, said push rod means and annular means having cooperating means whereby when the moveable member is first moved to open the valve means the ampule means is broken whereby the second material is mixed with the first material in said chamber.

2. The dispenser of claim 1 wherein: the container includes a transparent side wall whereby the contents of the container and the condition of the frangible ampule means can be visually inspected.

3. The dispenser of claim 1 including: biasing means engageable with the moveable member and housing to bias the valve means to a closed position, said biasing means and filter holding the push rod means adjacent the ampule means.

4. The dispenser of claim 1 wherein: the filter has a bottom wall having a hole, said push rod means extended through said hole into the top of the annular means.

5. The dispenser of claim 1 wherein: said moveable member includes a tubular stem projected upwardly from the cap, and a rod member mounted on the stem closing said tubular stem whereby when the moveable member is moved to open the valve means and break the ampule means propellant and materials are not discharged from the dispenser, said rod member being removable from said stem thereby opening the tubular stem so that propellant and materials can be discharged from the dispenser when the valve means is open.

6. The dispenser of claim 5 including: a button mounted on the rod member, said button having a recess accommodating a portion of the rod member whereby the button is retained on the rod member.

7. The dispenser of claim 5 including: actuator means mounted on the cap, said rod member extended through the actuator means to close said tubular stem whereby when the rod member is removed from the stem the actuator means can be used to open the valve means and discharge propellant and materials from the dispenser.

8. The dispenser of claim 1 wherein: said annular means comprises a sleeve means having a sleeve passage accommodating said portion of the ampule means.

9. The dispenser of claim 8 wherein: said cooperating means comprises an inwardly and downwardly sloping edge on the sleeve means and an inwardly and downwardly sloping shoulder on said push rod means facing said edge, said shoulder and edge being engageable with each other when the moveable member is moved to open the valve means and move the push rod means laterally thereby breaking the ampule means.

10. The dispenser of claim 9 including: a convex shaped finger on said push rod means extending downwardly from said shoulder into the sleeve passage adjacent said ampule means, said finger having side edges that engage an inner surface of the sleeve means when the valve means is in a closed position.

11. The dispenser of claim 1 wherein: said moveable member includes a tubular stem projected upwardly from the cap, said stem having a passage for carrying propellant and materials from the valve means when the valve means is open, nozzle means mounted on the stem, said nozzle means having a propellant and materials discharge orifice in communication with the passage in the stem for directing foam to a selected location, and button means mounted on the stem for preventing propellant and materials from being discharged from the nozzle means during the breaking of the ampule means, said button means being removable from said nozzle means thereby opening the tubular stem so that propellant and materials can be discharged from the nozzle means when the valve means is open.

12. The dispenser of claim 11 wherein: said cap means has a sleeve with a blind hole, said nozzle means having a portion thereof located within said blind hole.

13. The dispenser of claim 11 wherein: said nozzle means has an outwardly directed shoulder, and said button means has an annular edge engageable with the shoulder when the button means is mounted on the nozzle means.

14. An aerosol foam dispenser comprising: a container having an internal chamber for storing a propellant and at least one first component to be dispensed therefrom, normally closed valve means mounted on said container to retain the propellant and component in said chamber, said valve means being moveable to an open position to dispense foam to a desired location, filter means mounted on said valve means to prevent foreign particles from entering the valve means, frangible ampule means located within said chamber containing a second component that is separated from the first component within the chamber until said ampule means is broken, means holding the ampule in said chamber generally along the length of said chamber, and rod means mounted on said valve means engageable with said means for holding the ampule means, said filter means having a hole accommodating said rod means whereby said rod means extends through said filter means toward said ampule means, said rod means on first movement of the valve means to the open position engages said ampule means to break said ampule means thereby releasing the second component into said chamber whereby the first and second components are mixed together.

15. The dispenser of claim 14 wherein: said ampule means is a generally cylindrical sealed vial holding a chemical including said second component, said vial having a longitudinal axis generally parallel to the longitudinal axis of said chamber.

16. The dispenser of claim 14 wherein: the means for holding the ampule means comprises a sleeve having a passage accommodating an end portion of the ampule means.

17. The dispenser of claim 16 wherein: the rod means comprises a push rod connected to the valve means, said push rod having a portion engageable with said sleeve on movement of the valve means to the open position to break the ampule means, said push rod supported and guided by the filter.

18. The dispenser of claim 17 wherein: said sleeve has an inwardly and downwardly sloping top edge, said push rod portion including a downwardly and inwardly sloping shoulder facing said edge, said shoulder being engageable with said edge when the valve means is moved to the open position to break the ampule means.

19. The dispenser of claim 18 including: a convex shaped finger on said push rod extended downwardly from said shoulder into the sleeve passage adjacent the ampule means, said finger having side edges that engage an inner surface of the sleeve when the valve means is in a closed position.

20. The dispenser of claim 14 including: means for preventing the dispensing of foam when the valve means is first moved to the open position to break the ampule means.

21. The dispenser of claim 20 including: nozzle means having a discharge orifice connected to the valve means for receiving propellant and materials and directing propellant and materials to a selected location, said means for preventing the dispensing of foam including button means mounted on the nozzle means for preventing propellant and materials from being discharged from the nozzle means during the breaking of the ampule means, said button means being removable from said nozzle means thereby allowing propellant and materials to be discharged from the nozzle means when the valve means is open.

22. The dispenser of claim 21 wherein: said button means has a sleeve with a blind hole, said nozzle means having a portion thereof located within said blind hole.

23. The dispenser of claim 22 wherein: said nozzle means has an outwardly directed shoulder, and said button means has an annular edge engageable with the shoulder when the button means is mounted on the nozzle means.

24. An aerosol foam dispenser comprising: a container having an internal chamber for storing a propellant and a first material, normally closed valve means mounted on said container to retain the propellant and first material in said chamber, said valve means being moveable to an open position to dispense foam to a desired location, at least one frangible ampule means located in the chamber containing a second material separate from the first material, means holding the ampule means in said chamber generally along the length of the chamber, rod means engageable with the valve means and said means for holding the ampule means, said rod means having an end portion movable between said means for holding the ampule means and the ampule means operable to break said ampule means when the valve means is first moved to the open position thereby releasing the second material into said chamber whereby the first and second materials are mixed together.

25. The dispenser of claim 24 wherein: the means holding the ampule means in said chamber comprises a sleeve having a passage accommodating an end portion of the ampule means.

26. The dispenser of claim 25 wherein: the means engageable with said means for holding the ampule means comprises a push rod having a portion engageable with said sleeve whereby on relative movement of the push rod and sleeve the push rod breaks the ampule means, a filter mounted on the valve means, a said push rod extended through said filter and being supported and guided thereby.

27. The dispenser of claim 26 wherein: said sleeve has an inwardly and downwardly sloping edge, said push rod portion including a downwardly and inwardly sloping shoulder facing said edge, said shoulder being engageable with said edge when the valve means is moved to the open position to break the ampule means.

28. The dispenser of claim 27 including: a convex shaped finger on said push rod extended downwardly from said shoulder into the sleeve passage adjacent the ampule means, said finger having side edges that engage an inner surface of the sleeve when the valve means is in a closed position.

29. The dispenser of claim 24 including: means for preventing the dispensing of foam when the valve means is first moved to the open position to break the ampule means.

30. The dispenser of claim 29 including: nozzle means having a discharge orifice connected to the valve means for receiving propellant and materials and directing propellant and materials to a selected location, said means for preventing the dispensing of foam including button means mounted on the nozzle means for preventing propellant and materials from being discharged from the nozzle means during the breaking of the ampule means, said button means being removable from said nozzle means thereby allowing propellant and materials to be discharged from the nozzle means when the valve means is open.

31. The dispenser of claim 30 wherein: said button means has a sleeve with a blind hole, said button nozzle means having a portion thereof located within said blind hole.

32. The dispenser of claim 30 wherein: said nozzle means has an outwardly directed shoulder, and said button means has an annular edge engageable with the shoulder when the button means is mounted on the nozzle means.

33. An aerosol dispenser comprising: a container having a transparent side wall, a bottom wall, an open top, and a chamber for storing a propellant and a first material under pressure, a cap mounted on the container closing said open top whereby the propellant and first material is stored in the chamber under pressure, a housing extended into the chamber through said open top, said housing having a passage, control valve means mounted on the cap and housing operable to control the flow of propellant and materials from said passage, said control valve means being normally closed and having a moveable body extended into the passage which can be moved to open said valve means whereby propellant and material are dispensed from the container, porous filter means mounted on the housing to prevent foreign particles from flowing into the passage whereby when the valve means is open the propellant and material in said chamber flow through the filter into the passage, frangible ampule means located within said chamber generally along the length of the chamber for storing a second material separate from the first material until the ampule means is broken, sleeve means located in said chamber having a passage accommodating a portion of the ampule means, push rod means connected to the body and extended through the filter means being supported and guided thereby, said push rod means having an end located adjacent the sleeve and ampule means, said sleeve having an inwardly and downwardly sloping edge, said end of the push rod having an inwardly and downwardly directed shoulder facing said edge of the sleeve whereby when the body is moved to first open the valve means the shoulder engages the edge of the sleeve moving the end of the push rod into engagement with the ampule means thereby breaking the ampule means so that the second material is mixed with the first material in the chamber.

34. The dispenser of claim 33 including: biasing means engageable with the moveable body and housing to bias the valve means to a closed position, said biasing means and filter means holding the end of the push rod adjacent the sleeve and ampule means.

35. The dispenser of claim 33 wherein: said push rod includes a downwardly directed convex shaped finger located within the passage of the sleeve adjacent the ampule means, said finger having side edges that engage an inner surface of the sleeve when the valve means is in a closed position.

36. The dispenser of claim 33 wherein: the filter means has a bottom wall having a hole, said push rod extended through said hole with a sliding fit.

37. The dispenser of claim 33 wherein: said moveable body includes a tubular stem projected upwardly from the cap, and a rod member mounted on the stem closing said tubular stem whereby when the moveable member is moved to open the valve means and break the ampule means propellant and materials are not discharged from the dispenser, said rod member being removable from said stem thereby opening the tubular stem so that propellant and materials can be discharged from the dispenser when the valve means is open.

38. The dispenser of claim 37 including: a button mounted on the rod member, said button having a recess accommodating a portion of the rod member whereby the button is retained on the rod member.

39. The dispenser of claim 37 including: actuator means mounted on the cap, said rod member extended through the actuator means to close said tubular stem whereby when the rod member is removed from the stem the actuator means can be used to open the valve means and discharge propellant and materials from the dispenser.

40. The dispenser of claim 33 including: means for preventing the dispensing of propellant and materials when the control valve means is first moved to the open position to break the ampule means.

41. The dispenser of claim 40 including: nozzle means having a discharge orifice connected to the valve means for receiving propellant and materials and directing propellant and materials to a selected location, said means for preventing the dispensing of foam including button means mounted on the nozzle means for preventing propellant and materials from being discharged from the nozzle means during the breaking of the ampule means, said button means being removable from said nozzle means thereby allowing propellant and materials to be discharged from the nozzle means when the valve means is open.

42. The dispenser of claim 41 wherein: said button means has a sleeve with a blind hole, said nozzle means having a portion thereof located within said blind hole.

43. The dispenser of claim 41 wherein: said nozzle means has an outwardly directed shoulder, and said means has an annular edge engageable with the shoulder when the button means is mounted on the nozzle means.

44. An aerosol dispenser comprising: a container having an internal chamber for storing a propellant and at least one first component to be sprayed therefrom, normally closed valve means mounted on said container to retain the propellant and component in said chamber, said valve means being moveable to an open position to dispense aerosol to a desired location, filter means mounted on the valve means to prevent foreign particles from flowing into the valve means, frangible ampule means located within said chamber containing a second component that is separated from the first component within the chamber until said ampule means is broken, means for holding the ampule means in said chamber, means mounted on said valve means extended through the filter means and engageable with said ampule means to break said ampule means when the valve means is first moved to the open position thereby releasing the second component into said chamber whereby the first and second components are mixed together, said valve means having a tubular stem with an outlet passage for the propellant and materials in the chamber of the container, and means mounted on the stem for closing the outlet passage for preventing the dispensing of propellant and materials when the valve means is first moved to the open position to break the ampule means.

45. The dispenser of claim 44 wherein: the means mounted on said valve means extended through the filter and engageable with said ampule means includes a push rod, the push rod being supported and guided by the filter.

46. The dispenser of claim 44 wherein: the means mounted on the stem for closing the outlet passage comprises a rod member.

47. The dispenser of claim 46 including: actuator means mounted on the container, said rod member extended through the actuator means to close said outlet passage whereby when the rod member is removed from the stem the actuator means can be used to open the valve means and discharge propellant and materials from the container.

48. The dispenser of claim 47 including: a cover mounted on the actuator means to prevent accidental dispensing of propellant and materials from the container and rupture of the ampule means.

49. The dispenser of claim 44 wherein: the means mounted on said stem includes button means having a blind hole accommodating a portion of the stem.

50. A method of storing and subsequently dispensing a mousse hair care composition having at least two parts from a container having a chamber, an open end closed with a valve having a movable valving member normally located in a closed position, comprising: storing one part of the hair care composition in the enclosed chamber of said container, subjecting said one part of the hair care composition to pressure of a propellant, storing the other part of the hair care composition in a frangible vessel located in said enclosed chamber, breaking said frangible vessel within said enclosed chamber without allowing the one part of the hair care composition to escape from the chamber by moving the valving member from the closed position to the open position, preventing the hair care composition and propellant from escaping from the chamber through the open valve, mixing the one part and other part of the hair care composition in said enclosed chamber, and moving the valving member from the closed position to the open position to dispense said mixed parts of the hair care composition and propellant as a mousse to a desired location.

51. The method of claim 50 including: filtering said mixed parts of the hair composition within the enclosed chamber before the dispensing thereof.

* * * * *